United States Patent [19]

Tanahashi

[11] Patent Number: 4,602,701

[45] Date of Patent: Jul. 29, 1986

[54] APPARATUS FOR CONTROLLING THE SPEED OF AN ELEVATOR

[75] Inventor: Toru Tanahashi, Gifu, Japan

[73] Assignee: Mitsubishi Denki Kabushiki Kaisha, Tokyo, Japan

[21] Appl. No.: 673,274

[22] Filed: Nov. 20, 1984

[30] Foreign Application Priority Data

Nov. 28, 1983 [JP] Japan ..... 58-223445

[51] Int. Cl.[4] ..... B66B 1/30

[52] U.S. Cl. ..... 187/29 R

[58] Field of Search ..... 187/29

[56] References Cited

U.S. PATENT DOCUMENTS 4,482,031 11/1984 Yoshida et al. ..... 187/29 R 4,519,479 5/1985 Tanahashi ..... 187/29 R

FOREIGN PATENT DOCUMENTS 162978 12/1981 Japan .

*Primary Examiner*—William M. Shoop, Jr.

*Assistant Examiner*—W. E. Duncanson, Jr.

*Attorney, Agent, or Firm*—Leydig, Voit & Mayer, Ltd.

[57] ABSTRACT

An apparatus for controlling the speed of an elevator, which controls an AC electric motor that drives the cage, by using a power rectifier made up of thyristors and a power inverter made up of a transistor and a diode. A speed instruction for the cage is compared with a detected speed to produce an output instruction signal for said power rectifier and a slip frequency instruction signal for said power inverter. A control circuit controls the phase of said power rectifier relying upon the output instruction signal and controls the pulse-width modulation of said power inverter relying upon said slip frequency instruction signal, the control circuit comprises a voltage detector that detects the voltage of the AC power source, and a minimum value select circuit that receives the output of said voltage detector as a first input, that receives said output instruction signal as a second input, that compares these inputs, and that produces a signal of the same level as the signal of the lower level. The output of said minimum value select circuit is produced as a corrected output instruction signal to control the phase of said power rectifier.

7 Claims, 6 Drawing Figures

APPARATUS FOR CONTROLLING THE SPEED OF AN ELEVATOR

BACKGROUND OF THE INVENTION

1. Field of the Invention

The present invention relates to an apparatus for controlling the speed of an elevator, which controls an AC electric motor that drives the cage, by using a power rectifier (hereinafter referred to as a converter) comprising thyristors and a power inverter (hereinafter referred to as an inverter) comprising a transistor and a diode.

2. Description of the Prior Art

FIG. 1 is a block diagram illustrating the structure of a conventional apparatus for controlling the speed of an elevator, which is disclosed, for example, in Japanese Patent Laid-Open No. 162978/1981, wherein reference numeral 1 denotes a three-phase AC power source, reference numeral 2 denotes a vonverter which consists of thyristors and which converts an AC power source voltage into a direct current, numeral 3 denotes a capacitor for smoothing the output of the converter, numeral 4 denotes a converter which consists of a transistor and a diode, and which converts the DC voltage smoothed by the capacitor 3 into an alternating current of which the voltage and frequency can be changed, numeral 5 denotes a three-phase induction motor (hereinafter simply referred to as an electric motor) that is an AC electric motor, numeral 6 denotes a speed detector such as tachometer generator which is directly coupled to the electric motor 5, numeral 7 denotes a sheave rotated by the electric motor 5, numeral 8 denotes a rope wound on the sheave, numeral 9 denotes a cage coupled to an end of the rope, and numeral 10 denotes a counter weight coupled to the other end of the rope.

Reference numeral 11 denotes a speed instruction generator which generates a speed instruction signal 11*a*, numeral 12 denotes a speed control operation circuit which compares the speed instruction signal 11*a* with a speed signal 6*a* of the speed detector 6 to produce an output instruction signal 12*a* for the converter 2 and a slip frequency instruction signal 12*b* for the inverter 4, reference numeral 13 denotes a voltage detector which detects the voltage across the ends of the capacitor 3, numeral 14 denotes a voltage control operation circuit which compares the output instruction signal 12*a* with a voltage signal 13*a* of the voltage detector 13 to produce a voltage instruction signal, numeral 15 denotes a phase circuit which generates gate pulses to control the thyristors that constitute the converter 2 in response to the voltage instruction signal, numeral 16 denotes a voltage instruction generator circuit which generates a voltage instruction signal of a sinusoidal wave responsive to the speed signal 6*a* and the slip frequency instruction signal 12*b*, numeral 17 denotes a voltage detector circuit which detects the output voltage of the inverter 4, numeral 18 denotes a pulse-width modulation comparator which compares the voltage instruction signal of the voltage instruction generator circuit 16 with the voltage signal of the voltage detector circuit 17 to generate a pulse-width modulation instruction signal, numeral 19 denotes a base drive circuit which, responsive to the pulse-width modulation instruction signal, generates a gate signal to control the transistor which constitutes the inverter 4.

In the thus constructed apparatus for controlling the speed of an elevator, a three-phase AC voltage is rectified and smoothed through the converter 2 and the capacitor 3. An AC voltage of which the pulse width is modulated by the inverter 4 is then supplied to the electric motor 5, and the cage 9 starts to run.

At this time, the speed detector 6 detects the revolving speed of the electric motor 5, and applies the speed signal 6*a* of cage 9 to the speed control operation circuit 12 which compares the speed signal 6*a* with the speed instruction signal 11*a* to produce an output instruction signal 12*a* and a slip frequency instruction signal 12*b* which are applied to the voltage control operation circuit 14 and to the voltage instruction generator circuit 16, respectively.

With the output instruction signal 12*a* and a setpoint value and with the speed signal of the voltage detector 13 as a value that is fed back, the voltage control operation circuit 14 produces a voltage instruction signal, so that the deviation between these two values will become zero. The phase circuit 15 then receives the voltage instruction signal and controls the thyristors of the inverter 2.

Relying upon the slip frequency instruction signal 12*b* and the speed signal 6*a*, the voltage instruction generator circuit 16 produces a voltage instruction signal of a sinusoidal wave that will be applied to the pulse-width modulation comparator 18. With the voltage instruction signal as a setpoint value and the voltage signal of the voltage detector circuit 17 as a value that is fed back, the pulse-width modulation comparator 18 produces a pulse-width modulation instruction signal, so that the deviation between these value will become zero, and applies the pulse-width modulation instruction signal to the base drive circuit 19 which then controls the base current of the inverter 4.

Thus, the voltage and frequency applied to the electric motor 5 are controlled, and the speed of the cage 9 is controlled precisely in accordance with the speed instruction signal 11*a* of the speed instruction generator 11.

FIG. 2 is a circuit diagram which shows in detail the aforementioned voltage control operation circuit 14 which consists of resistors 20 and 21 of which the ends on one side are connected to the speed control operation circuit 12 and the voltage detector 13, respectively; an operational amplifier 24 of which the inverting input terminal (−) is connected to the ends on the other side of these resistors and of which the output terminal is connected to the phase circuit 15; a resistor 22 and a capacitor 23 are connected between the inverting input terminal (−) of the operational amplifier 24 and the output terminal of the operational amplifier 24; and a comparator 25 of which one input terminal is connected to the output terminal of the operational amplifier 24 and the other input terminal is connected to a reference voltage $V_{ref}$, and of which the output terminal is connected to the phase circuit 15.

In FIG. 2, as the voltage instruction signal 12*a* is applied through the resistor and the voltage signal 13*a* through the resistor 21, a voltage signal 24*a* corresponding to the difference between the two input signals is applied to the phase circuit 15. The comparator 25 determines the level of the voltage signal 24*a*. When the level exceeds a predetermined value, a signal is applied to the phase circuit 15 to regenerate the electric power back to the power source, i.e., a bank switching signal 25*a* of the converter 2 is applied to the phase circuit 15.

In the speed control apparatus of this type, if the power source voltage is denoted by $V_{ac}$, and a maximum output voltage of the converter 2 by $E_D$ while neglecting the voltage drop of the thyristor, there exists a relation $E_D = 1.35\ V_{ac}$[V].

If now the power source voltage $V_{ac}$ drops due to some reasons, the output voltage of the converter 2 drops, also. Therefore, the output voltage of the operational amplifier 24 increases to compensate for the voltage drop. When the voltage drop is relatively great, however, the output voltage signal 24*a* of the operational amplifier 24 saturates from a time $t_1$ to a time $t_2$ as shown in FIG. 3, and the voltage instruction signal 12*a* often becomes greater than the voltage signal 13*a*. Namely, the output corresponding to the voltage instruction signal 12*a* is not always obtained. In this case, if the inverter 4 is shifted from the powering operation to the regenerative operation, operation of the comparator 25 is delayed due to the saturation of the operational amplifier 24, and the voltage rises across the terminals of the capacitor 3. Further, since the power source voltage is low, it becomes difficult to control the current on the regenerative side; i.e., an excess current flows into the thyristor bank on the regenerative side.

SUMMARY OF THE INVENTION

The present invention eliminates the above-mentioned defects, and has for its object to provide an apparatus for controlling the speed of an elevator, which has a voltage detector to detect an AC power source voltage, and which also has a minimum value select circuit that compares a voltage signal of the voltage detector and an output instruction for the converter for controlling the speed and that applies, as a corrected output instruction, a signal having the same level as the signal of the lower level to the voltage control circuit of the converter, in order to prevent beforehand an excess current from flowing into the thyristor bank of the regenerative side constituting the converter.

DESCRIPTION OF THE PREFERRED EMBODIMENT

Figure 1:
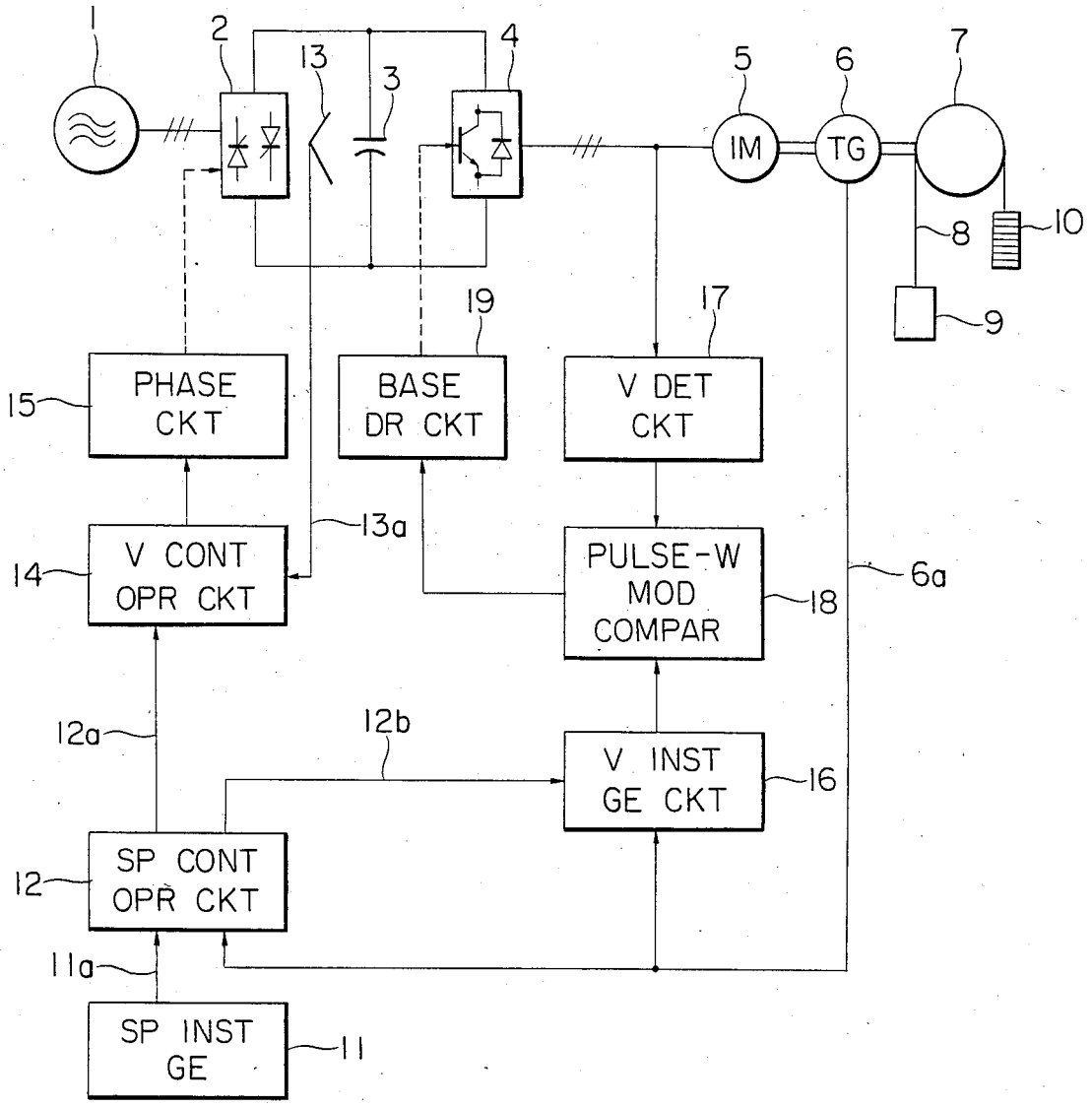
FIG. 1 PRIOR ART
FIG. 1 is a block diagram illustrating the structure of a conventional apparatus for controlling the speed of an elevator.
Figure 2:
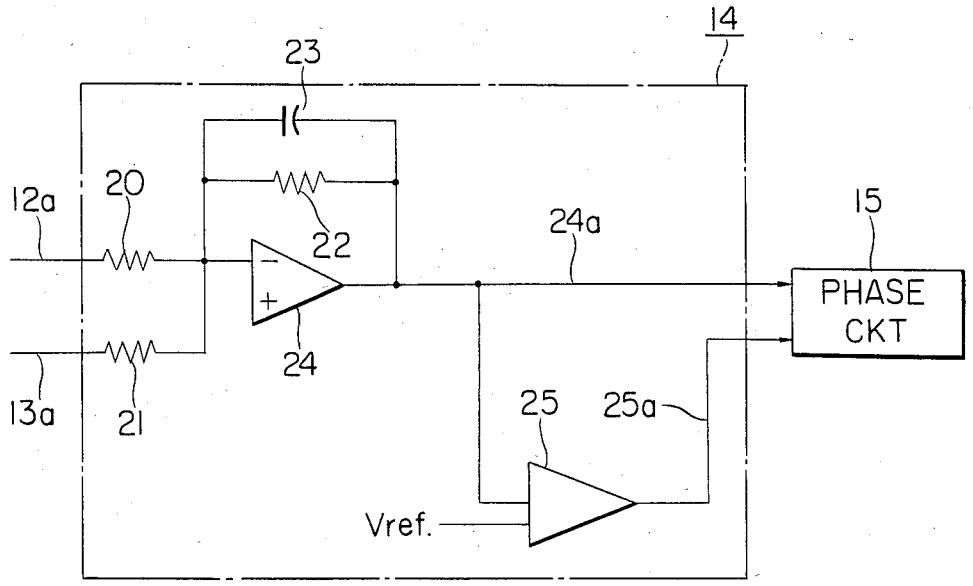
FIG. 2 PRIOR ART
FIG. 2 is a circuit diagram which illustrates in detail the major elements of the apparatus for controlling the speed.
Figure 3:
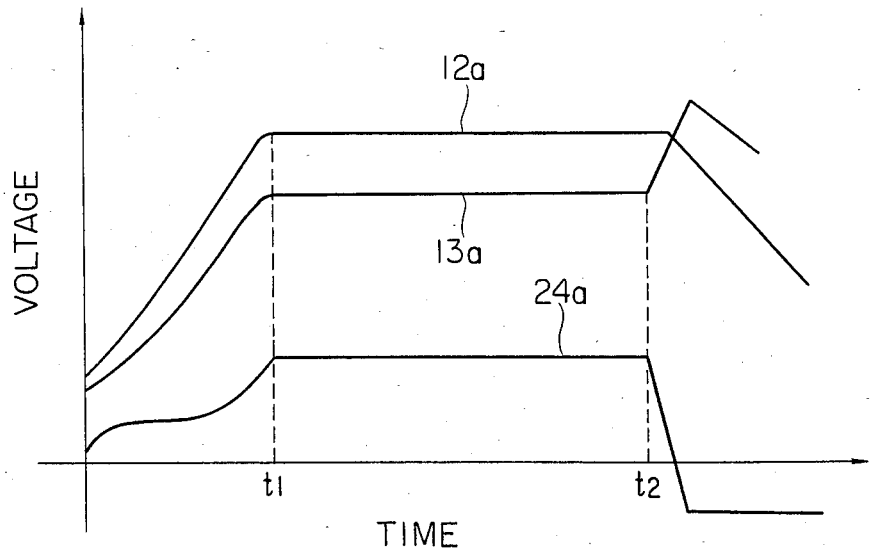
FIG. 3 PRIOR ART
FIG. 3 is a waveform diagram for explaining the function of the apparatus for controlling the speed.
Figure 4:
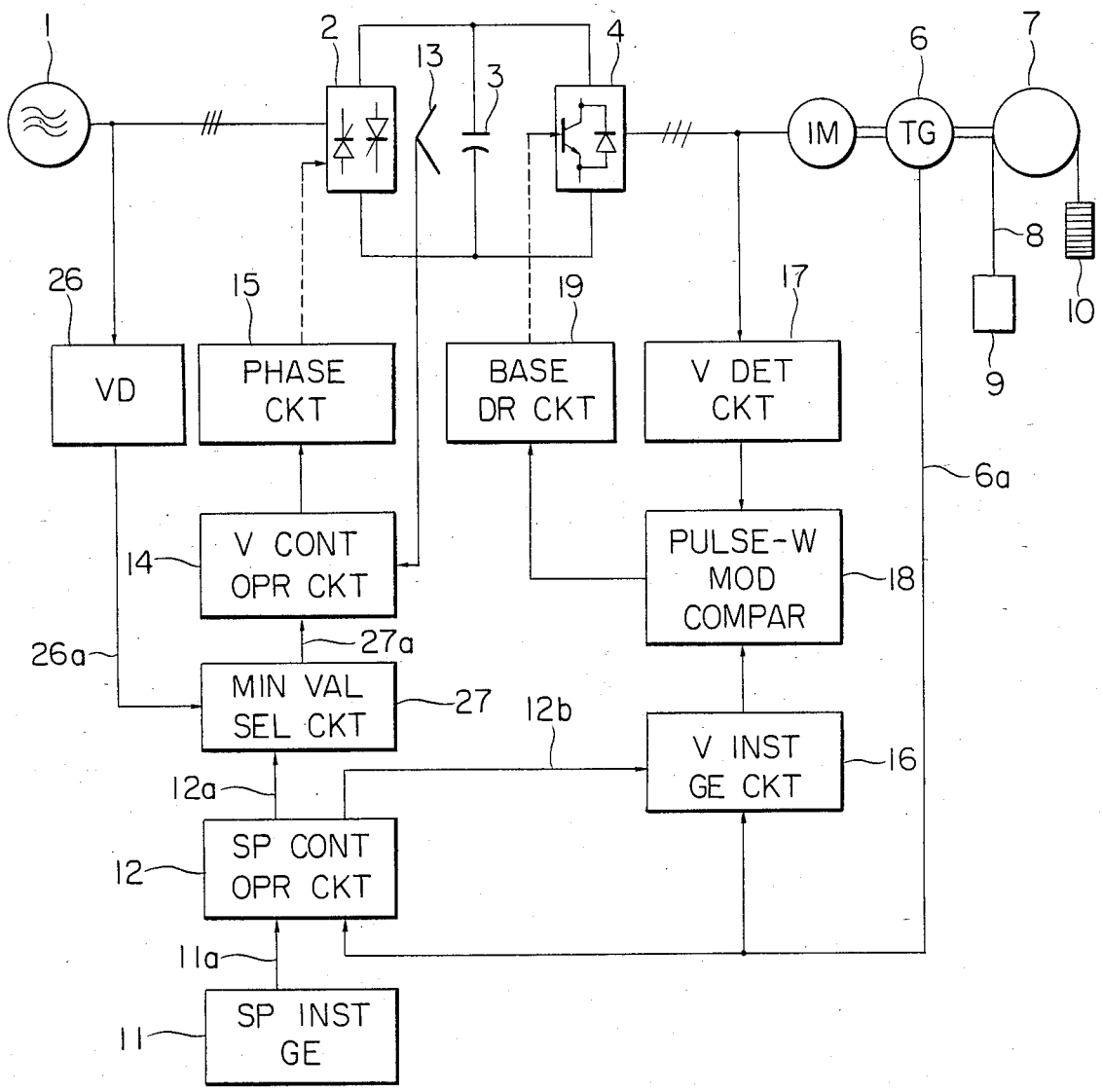
FIG. 4 is a block diagram illustrating the structure of an apparatus for controlling the speed of an elevator according to an embodiment of the present invention.

FIG. 4 is a block diagram illustrating the structure of an apparatus for controlling the speed of an elevator according to an embodiment of the present invention, wherein the same reference numerals as those of FIG. 1 denote the same elements. What makes this embodiment different from the apparatus of FIG. 1 is the provision of a voltage detector 26 that detects the AC power source voltage, and a minimum value select circuit 27 that receives a voltage signal 26*a* of the voltage detector 26 and an output instruction signal 12*a* of the speed control operation circuit 12, that compares these two signals, and that applies, as a corrected output instruction, a signal having the lower level than to the voltage control operation circuit 14.

Figure 6:
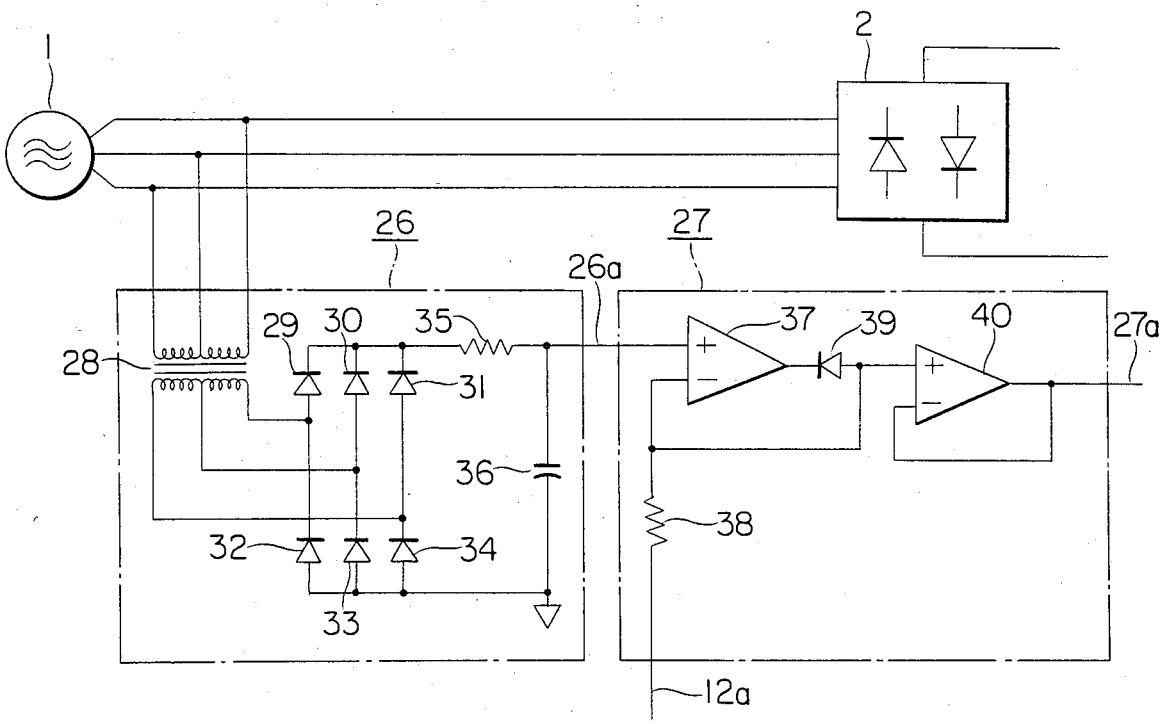
FIG. 6 is a circuit diagram which illustrates in detail the major elements of the above embodiment.

FIG. 6 is a circuit diagram illustrating in detail the structures of the voltage detector 26 and the minimum value select circuit 27. First, the voltage detector 26 is comprised of a three-phase transformer 28 (hereinafter referred to as transformer) of which the primary side is connected to the AC power source, a rectifier circuit which is connected to the secondary side of the transformer 28 and which is made up of six diodes 29 to 34 that are bridge-connected, and a resistor 35 and a capacitor 36 for smoothing the rectified output. The minimum value select circuit 27 is comprised of an operational amplifier 37 which receives the voltage signal 26*a* of the voltage detector 26 through a non-inverting input terminal (+) thereof and which receives the output instruction signal 12*a* of the speed control operation circuit 12 through an inverting input terminal (−) thereof via an input resistor 38, a diode 39 which is connected to the output of the operational amplifier 37 so that the operational amplifier 37 will operate effectively when a relation between the voltage signal 26*a* and the output instruction signal 12*a* is 26*a* < 12*a*, and a buffer amplifier 40 which receives the output of the operational amplifier 37 and which produces a corrected output instruction signal 27*a* while suppressing the signal 27*a* below the level of the voltage signal 26*a*.

The function of the thus constructed apparatus for controlling the speed of an elevator will be described here below by mainly emphasizing the features which distinguish this embodiment from the apparatus of FIG. 1.

First, the voltage detector 26 detects the voltage of the AC power source 1, and applies a voltage signal 26*a* of the same kind as the output instruction signal 12*a* to the operational amplifier 37 of the minimum value select circuit 27. If the voltage signal 26*a* is greater than the output instruction signal 12*a*, the output of the operational amplifier 37 is invalidated by the function of the diode 39, whereby the output instruction signal 12*a* becomes equal to the output of the buffer amplifier 40, and an output instruction 27*a* equal to the output instruction signal 12*a* is produced.

Then, as the voltage signal 26*a* becomes smaller than the output instruction signal 12*a* due to a drop in the AC power source voltage, the operational amplifier 37 becomes effective, and the output instruction signal 27*a* is limited to the level of the voltage signal 26*a* of the voltage detector 26.

Thus, the minimum value select circuit 27 receives the output voltage signal 26*a* of the voltage detector 26 as a first input, receives the output instruction signal 12*a* of the speed control operation circuit 12 as a second input, compares these two inputs, and produces a signal which corresponds to the lower level input signal.

Figure 5:
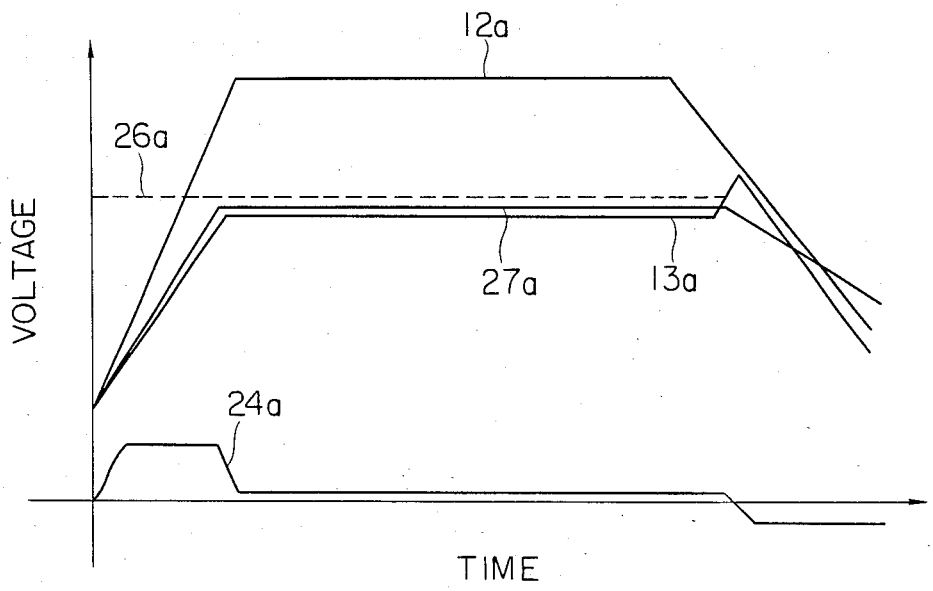
FIG. 5 is a waveform diagram for explaining the function of the above embodiment.

FIG. 5 illustrates a relation therebetween, as well as the output condition of the operational amplifier 24 of the voltage control operation circuit 14. As long as the voltage signal 26*a* remains lower than the output instruction signal 12*a*, the output instruction signal 12*a* is limited, and the output instruction 27*a* is applied to the voltage control operation circuit 14. Accordingly, the operational amplifier 24 does not saturate, and the voltage across the terminals of the capacitor 3 is maintained low as will be obvious from the voltage signal 13*a*.

Therefore, an excess current is prevented from flowing into the onverter.

When the output voltage of the converter 2 is lowered, the output voltage of the inverter 4 decreases also, and the output waveform therefrom approaches a square wave, causing a sinusoidal waveform to be slightly distorted. This, however, does not cause any substantial hindrance in the control characteristics.

According to the present invention as will be obvious from the foregoing description, the power source voltage is detected and the output instruction is limited to a low value. In the regenerative operation, therefore, an excess current is reliably prevented from flowing into the thyristors that constitute the converter.

What is claimed is:

1. An apparatus for controlling the speed of elevator, comprising:

a power rectifier which includes thyristors and which converts an AC power source voltage into a direct current;

a capacitor for smoothing the direct current of said power rectifier;

a power inverter which consists of a transistor and a diode, which converts the DC voltage smoothed by said capacitor into an alternating current having a variable voltage and a variable frequency, and which supplies the alternating current to an AC electric motor that drives the cage; and a control circuit which compares a speed instruction signal for said cage with a detected speed, which produces an output instruction signal for said power rectifier and a slip frequency instruction signal for said power inverter, which controls the phase of said power rectifier based upon the output instruction signal, and which controls the pulse-width modulation of said power inverter based upon said slip frequency instruction signal;

wherein said control circuit has a voltage detector which detects the voltage of the AC power source, and a minimum value select circuit which receives the output signal of said voltage detector as a first input, receives said output instruction signal as a second input, which compares these two inputs, and which produces a signal having the same level as the signal of the lower level, and wherein said control circuit supplies, as a corrected output instruction signal, the output signal of said minimum value select circuit to said power rectifier to control the phase thereof.

2. An apparatus for controlling the speed of an elevator according to claim 1, wherein said control circuit further comprises:

a speed control circuit which compares said speed instruction signal for the cage with the detected speed to produce an output instruction signal for said power rectifier and a slip frequency instruction signal for said power inverter; and a voltage control circuit which receives said output instruction signal of the speed control circuit and a voltage signal that represents the output voltage of said power rectifier, which compares these signals, and which produces a voltage signal to control said power rectifier;

and wherein said minimum value select circuit is connected between said speed control circuit and said voltage control circuit, and the output signal of said minimum value select signal is supplied to said voltage control circuit.

3. An apparatus for controlling the speed of an elevator according to claim 1, wherein when said electric motor is in a powering mode of operation, said power rectifier converts the output of said power source into a direct current that will be supplied to said power inverter and when said electric motor is in a regenerative mode of operation, a direct current is converted into an alternating current through said power inverter and is returned back to said power source, and wherein provision is further made of a thyristor bank to effect the powering and regeneration.

4. An apparatus for controlling the speed of an elevator according to claim 3, wherein said voltage control circuit comprises:

an operational amplifier which receives a signal consisting of said output instruction signal and the output voltage signal of said power rectifier, and which supplies an output signal to a phase circuit that generates gate pulses to control said power rectifier; and a comparator which receives the output signal of said operational amplifier through one of its input terminals, which receives a predetermined reference voltage, which compares these inputs, and which supplies an output signal to said phase circuit, so that the thyristor bank of either the powering side or the regenerative side of said power rectifier is rendered conductive.

5. An apparatus for controlling the speed of an elevator according to claim 1, wherein said voltate detector comprises:

a transformer having the primary side thereof connected to said power source;

a rectifier circuit connected to the secondary side of said transformer; and a smoothing circuit which smoothes the output of said rectifier circuit and produces an output as the detected voltage.

6. An apparatus for controlling the speed of an elevator according to claim 1, wherein said minimum value select circuit comprises:

an operational amplifier which receives said output instruction signal and a voltage signal of said voltage detector; and an amplifier which produces the output of said amplifier as said corrected output instruction signal.

7. An apparatus for controlling the speed of an elevator according to claim 6, wherein said operational amplifier has said voltage signal applied through a non-inverting input terminal thereof, has said output instruction signal applied through an inverting input terminal thereof, and the output terminal of said operational amplifier is connected to the cathode of a diode of which the anode is connected to said output amplifier.

* * * * *